US006781519B1

(12) United States Patent
Diaz

(10) Patent No.: US 6,781,519 B1
(45) Date of Patent: Aug. 24, 2004

(54) METHOD AND VEHICLE SYSTEM FOR REMOTE-CONTROLLING VEHICLE AUDIO SYSTEM

(75) Inventor: Melvin Diaz, LaPalma, CA (US)

(73) Assignee: Alpine Electronics, Inc., Tokyo (JP)

( * ) Notice: Subject to any disclaimer, the term of this patent is extended or adjusted under 35 U.S.C. 154(b) by 0 days.

(21) Appl. No.: 09/577,744

(22) Filed: May 23, 2000

(51) Int. Cl.[7] ..... G08C 19/00

(52) U.S. Cl. ..... 340/825.72; 340/825.69; 340/825.24; 340/5.64; 340/5.72; 455/130; 455/132; 455/140; 455/151.1; 455/151.2; 455/151.4

(58) Field of Search ..... 340/825.72, 825.69, 340/825.24, 5.64, 5.72; 455/130, 132, 140, 151.1, 151.2, 151.4, 345, 352; 341/176; 398/126

(56) References Cited

U.S. PATENT DOCUMENTS 4,809,359 A * 2/1989 Dockery ..... 398/126
5,625,608 A * 4/1997 Grewe et al. ..... 369/24.01
5,722,058 A * 2/1998 Umemoto et al. ..... 455/140
5,729,191 A 3/1998 Allen et al.
5,790,065 A * 8/1998 Yaroch ..... 341/173

* cited by examiner

*Primary Examiner*—Ario Etienne
*Assistant Examiner*—Yves Dalencourt
(74) *Attorney, Agent, or Firm*—Brinks Hofer GIlson & Lione

(57) ABSTRACT

A method for remotely controlling a vehicle audio system, which is controlled in accordance with an instruction from an infrared remote control unit, uses a radio frequency remote control unit to remotely control the vehicle audio system. A security system receives a command transmitted from the radio frequency remote control unit. In a security control mode, the vehicle security system performs security control based on the command. In an audio control mode, the security system transmits the command to an audio control interface unit. The audio control interface unit converts the command transmitted from the security system into an infrared remote control unit command. Based on the infrared remote control unit command, an infrared emitter is driven to emit infrared rays, thus controlling the vehicle audio system by the infrared rays.

19 Claims, 8 Drawing Sheets

FIG. 3

| Audio Control | Security Remote Control | |
|---|---|---|
| Function | Button(s) | Action |
| POWER ON / OFF | TX / PANIC | Press and release |
| Volume Up | TX / PANIC | Press and hold |
| Volume Down | ETX2 / EXT3 | Press and hold |
| Play / Pause | ETX2 / EXT3 | Press and release |
| Forward | MODE | Press and release |
| Reverse | ETX1 / VALET | Press and release |
| Up | EXT4 | Press and release |
| Down | ETX1 / VALET | Press and hold |
| Up | MODE | Press and hold |
| Visual Select | ETX2 / EXT3 + MODE | Press and release |
| Audio Select | TX / PANIC + MODE | Press and release |
| Band Program | TX / PANIC + ETX2 / EXT3 | Press and release |
| Mute | EXT1 / VALET + MODE | Press and release |

METHOD AND VEHICLE SYSTEM FOR REMOTE-CONTROLLING VEHICLE AUDIO SYSTEM

BACKGROUND OF THE INVENTION

1. Field of the Invention

The present invention relates to a method and a vehicle system for remote-controlling a vehicle audio system controlled in accordance with an instruction from an infrared remote control unit.

2. Description of the Related Art

A conventional vehicle audio system is controllable by operating an operation panel or an infrared remote control unit. FIG. 8 shows the vehicle audio system. Referring to FIG. 8, the vehicle audio system includes a head unit 1, which includes an FM/AM tuner 1*a,* a CD changer player 1*b,* and an MD or tape player 1*c.* A DVD player and/or other sources, e.g., an MP3 player, may also be provided. A source switching unit 2 selects an audio signal to be transmitted from predetermined audio sources in accordance with a switch instruction given by an audio control unit 3, and outputs the selected audio signal to a tone control unit 4. The tone control unit 4 for controlling the tone quality of the input audio signal performs, for example, equalizer control and high/low tone control in accordance with an instruction given by the audio control unit 3. A volume control unit 5 for controlling the volume performs volume control, loudness control, mute on/off control, and the like in accordance with an instruction given by the audio control unit 3. An amplifier 6 amplifies the input audio signal. A speaker 7 emits sound into the interior of a vehicle. An operating unit 8 performs operations such as power on/off, source switching, tone characteristics setting, volume up/down, AM/FM band switching, broadcasting station channel selection, play/stop/pause of the CD player 1*b* and the MD player 1*c,* fast-forward/reversing, and tune-forwarding of the CD player 1*b* and the MD player 1*c.* Just like the operating unit 8, an infrared remote control unit 9 emits infrared rays to instruct the audio system to perform various operations. The infrared rays are received by a remote control receiver 3a of the audio control unit 3.

The audio control unit 3 performs operations including power on/off control, source switching control, volume up/down control, and play/stop/pause control in accordance with an instruction given by the operating unit 8 or the infrared remote control unit 9.

As described above, the vehicle audio system can be operated by remote control using the infrared remote control unit 9. Although the range of the infrared rays emitted by the infrared remote control unit 9 is short, there is no problem as long as the infrared remote control unit 9 is used in the vehicle.

There are some drivers who enjoy having a picnic outside the vehicle while listening to the music played by the vehicle audio system. In such a case, the vehicle audio system is often required to be operated by remote control. However, the infrared remote control unit 9 having a short range often fails to remotely control the vehicle audio system. The maximum range of the infrared rays emitted by the infrared remote control unit 9 is approximately 25 feet. The range is further shortened due to light effects in the daytime. In addition, it is necessary to operate the infrared remote control unit 9 so that the infrared rays are emitted toward a light receiving section.

SUMMARY OF THE INVENTION

Accordingly, it is an object of the present invention to remotely control a vehicle audio system controlled by an instruction from an infrared remote control unit using a radio frequency remote control unit.

It is another object of the present invention to remotely control a vehicle audio system using a radio frequency remote control unit for transmitting a security control command to a security system by radio.

To this end, according to one aspect of the present invention, there is provided a method for remotely controlling a vehicle audio system, including a transmitting step of transmitting an audio control command for controlling the audio system by a high-frequency wireless signal; a demodulating step of demodulating the audio control command sent by the wireless signal; and an outputting step of outputting an infrared remote control signal based on the audio control command.

In the method, a radio frequency remote control unit of a vehicle security system may give an instruction to switch a control mode between an audio control mode and a security control mode. When mode switching is instructed and the control mode is switched to the audio control mode, the audio control command received from the radio frequency remote control unit may be converted into an infrared remote control unit command thereafter.

According to another aspect of the present invention, there is provided a vehicle system including an audio system which is remotely controlled by infrared rays; an infrared emitter for generating the infrared rays; a security system for receiving a command transmitted from a radio frequency remote control unit, performing security control in a security control mode based on the command (security command), and externally outputting the command transmitted from the radio frequency remote control unit as an audio control command in an audio control mode; and an audio control interface unit, connected to the security system, for converting the audio control command output from the security system into an infrared remote control unit command, and driving the infrared emitter based on the command.

According to the present invention, the audio system can be externally operated by remote control without hindrance. It is not necessary to provide an additional radio frequency remote control unit for controlling the audio system. With the audio control interface unit and the infrared emitter, the audio system can be operated by remote control using the radio frequency remote control unit.

Other features and advantages of the present invention will be apparent from the following description taken in conjunction with the accompanying drawings.

BRIEF DESCRIPTION OF THE DRAWINGS

FIG. 3 is a table describing functions and actions of keys on the radio frequency remote control unit in an audio control mode;

DESCRIPTION OF THE PREFERRED EMBODIMENT

Figure 1:
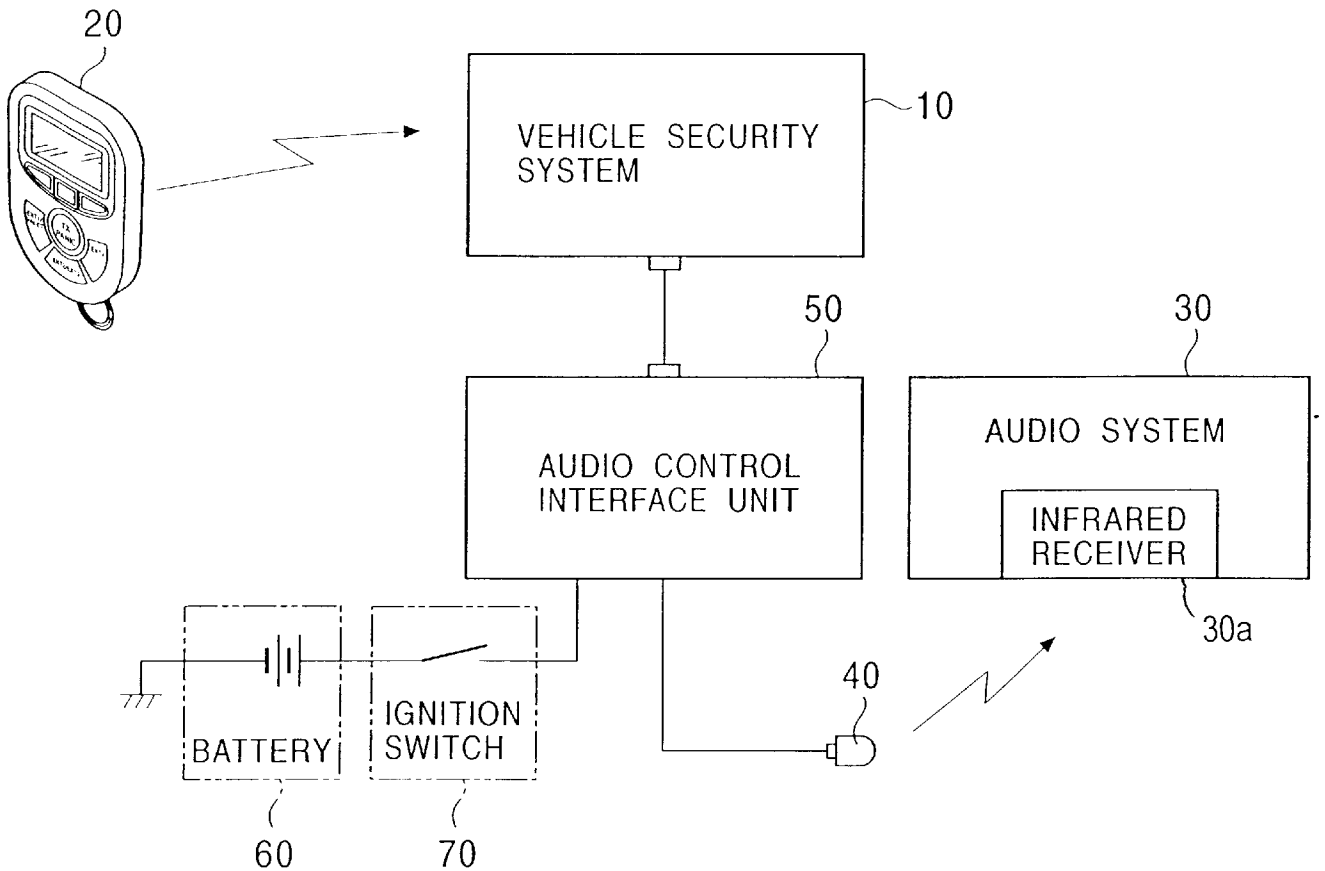
FIG. 1 is a block diagram of an overall vehicle system according to an embodiment of the present invention.

FIG. 1 is a block diagram of an overall vehicle system according to an embodiment of the present invention. Referring to FIG. 1, the vehicle system includes a vehicle security system 10 for preventing vehicle theft and a radio frequency remote control unit 20 for transmitting various control signals to the vehicle security system 10 by radio. The control commands are transmitted by key operations of the radio frequency remote control unit 20. The commands include a control mode switching command for switching a control mode between a security control mode and an audio control mode, a security control command for arming or disarming security, and an audio control command for performing power on/off, source switching, and volume up/down of an audio system 30. The vehicle security system 10 determines whether the control mode switching is instructed by the radio frequency remote control unit 20. When the determination is affirmative, the vehicle security system 10 switches the control mode. In the security control mode, the vehicle security system 10 regards the command transmitted from the radio frequency remote control unit 20 as the security control command and performs security control. In the audio control mode, the vehicle security system 10 regards the command transmitted from the radio frequency remote control unit 20 as the audio control command and externally outputs the command.

The audio system 30 includes an infrared remote control unit (not shown) and an infrared receiver 30*a* for receiving infrared rays emitted from an infrared emitter 40. The infrared emitter 40 is mounted at a position, such as on a ceiling of the vehicle interior, from which the infrared receiver 30*a* can receive the infrared rays.

An audio control interface unit 50 is connected to the vehicle security system 10. The audio control interface unit 50 converts the audio control command received from the vehicle security system 10 into an infrared remote control unit command. Based on the command obtained by the conversion, the audio control interface unit 50 generates an infrared remote control signal and drives the infrared emitter 40 based on the infrared remote control signal. A battery 60 and an ignition switch 70 apply a battery voltage to each part.

In the initial power-on state, the vehicle security system 10 is in the security control mode. The vehicle security system 10 performs security control based on the security control command transmitted from the radio frequency remote control unit 20. In this state, when the radio frequency remote control unit 20 transmits the control mode switching command, the vehicle security system 10 is switched to be in the audio control mode. Subsequently, the vehicle security system 10 regards the command received from the radio frequency remote control unit 20 as the audio control command and transmits the command to the audio control interface unit 50.

The audio control interface unit 50 converts the audio control command received from the vehicle security system 10 into the infrared remote control unit command, generates the infrared remote control signal based on the command obtained by the conversion, and inputs the infrared remote control signal to the infrared emitter 40. The infrared emitter 40 emits the infrared rays in response to the infrared remote control signal. The infrared receiver 30*a* of the audio system 30 receives the infrared rays emitted from the infrared emitter 40. The audio system 30 performs audio control (such as power on/off, source switching, and volume up/down) as instructed by the radio frequency remote control unit 20.

A wireless signal emitted from the radio frequency remote control unit 20 has a range of 100 to 200 feet and is non-directional. Hence, the radio frequency remote control unit 20 is not required to be operated toward the audio system 30, causing no problem at all in operating the vehicle audio system 30 by remote control from a picnic outside the vehicle.

Figure 2:
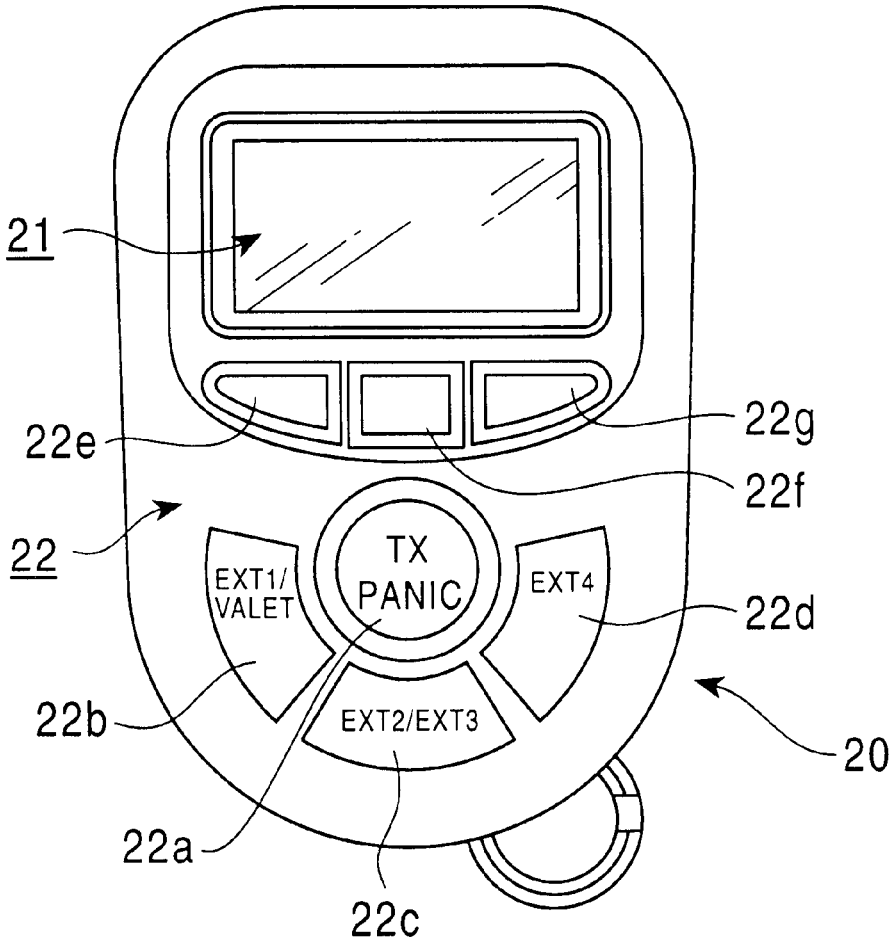
FIG. 2 is an external view of a radio frequency remote control unit for a vehicle security system.

FIG. 2 is an external view of the radio frequency remote control unit 20. The radio frequency remote control unit 20 is designed primarily for performing security control, and can be employed for remotely controlling the audio system 30 when the control mode is switched.

Referring to FIG. 2, a liquid crystal display (LCD) unit 21, disposed at an upper part of a surface of the radio frequency remote control unit 20, displays various settings, such as time and date. A key section 22 includes a TX/PANIC key 22*a* for alternately instructing the vehicle security system 10 to be in an armed state and a disarmed state; first to third extension keys (an EXT1 key, an EXT2/EXT3 key, and an EXT4 key) 22*b* to 22*d;* a mode key 22*e;* a date/time key 22*f* for causing the LCD unit 21 to sequentially display time, date, and security duration for each momentary press; and a car number key 22*g* for sequentially switching the number (1→2→3→4→1 and so forth) of a vehicle to be controlled for each momentary press. The mode key 22*e* switches between a time mode and a program mode for each momentary press. In the time mode, the time and date are displayed, and the time can be adjusted. In the program mode, a siren is sounded on/off every time the first extension key 22*b* is pressed; a sensor scan is switched on/off every time the second extension key 22*c* is pressed; and a chirp is sounded on/off every time the third extension key 22*d* is pressed.

The radio frequency remote control unit 20 can be employed for remotely controlling the audio system 30 when the control mode is switched. The switching is performed by simultaneously pressing and releasing the TX/PANIC key 22*a* and the EXT1/VALET key 22*b*. The radio frequency remote control unit 20 transmits two key codes of the TX/PANIC key 22*a* and the EXT1/VALET key 22*b* as the control mode switching command to the vehicle security system 10. The vehicle security system 10 switches the control mode in response to the control mode switching command, from the security control mode to the audio control mode, and vice versa.

A function of each key of the radio frequency remote control unit 20 in the security control mode is as described above. Referring now to FIG. 3, a function of each key of the radio frequency remote control unit 20 in the audio control mode is described. For example, when the TX/PANIC key 22*a* is pressed and released, power is turned on/off. When the TX/PANIC key 22*a* is pressed and held, the volume is turned up. When the EXT2/EXT3 key 22*c* is pressed and held, the volume is turned down. When the EXT2/EXT3 key 22*c* is pressed and released, a CD, an MD, or a tape is played or paused. Of course, the radio frequency remote control unit 20 can be used to control other sources as well, including a DVD player and/or an MP3 player.

Figure 4:
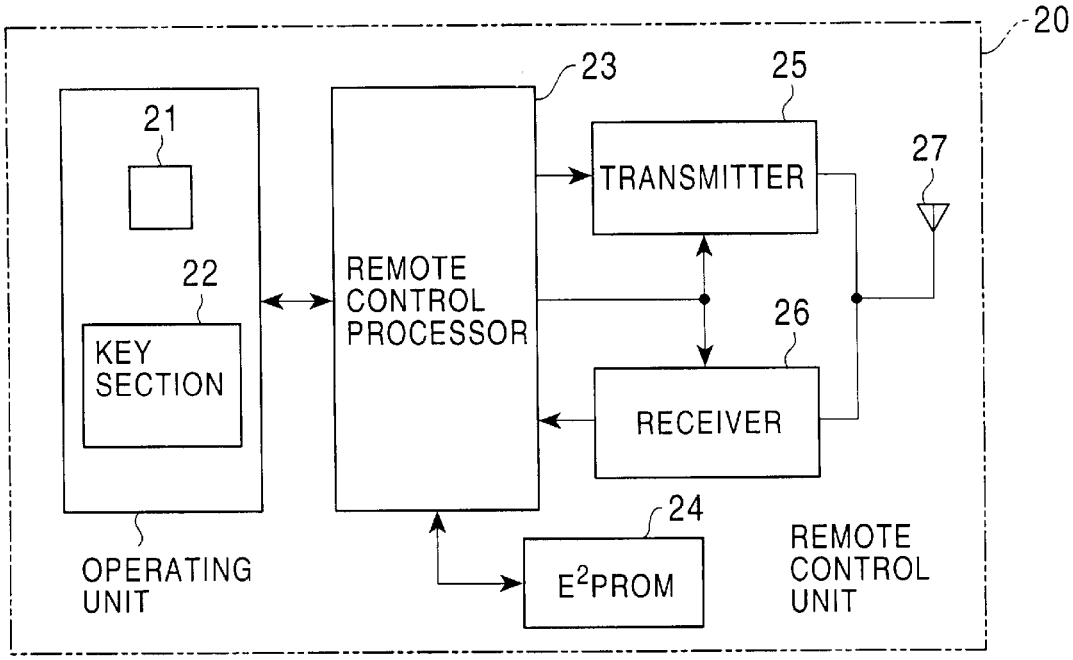
FIG. 4 is a circuit diagram of the radio frequency remote control unit.

FIG. 4 is a circuit diagram of the radio frequency remote control unit 20. The radio frequency remote control unit 20 includes the LCD unit 21; the key section 22; and a remote control processor 23, formed of a microcomputer, for processing in accordance with key operation, creating transmission data, Manchester-coding the transmission data, decoding Manchester-coded acknowledgement data transmitted from the vehicle security system 10, and processing in accordance with the acknowledgement data. The radio frequency remote control unit 20 further includes an $E^2$PROM 24, which is a non-volatile memory for storing ID codes or the like; a transmitter 25 for digitally modulating a carrier wave in a predetermined modulation system, such as frequency shift keying (FSK), based on the transmission data, and transmitting the modulated carrier wave; a receiver 26 for receiving the data transmitted from the vehicle security system 10 and demodulating the data; and a transmitting/receiving antenna 27.

As described, the radio frequency remote control unit 20 is capable of two-way communication. However, this is not required for the practice of the invention, and the radio frequency remote control unit 20 can simply include a one-way communication ability. The LCD display of the radio frequency remote control unit 20 also is not required, and the invention can be practiced without such a display.

Figure 5:
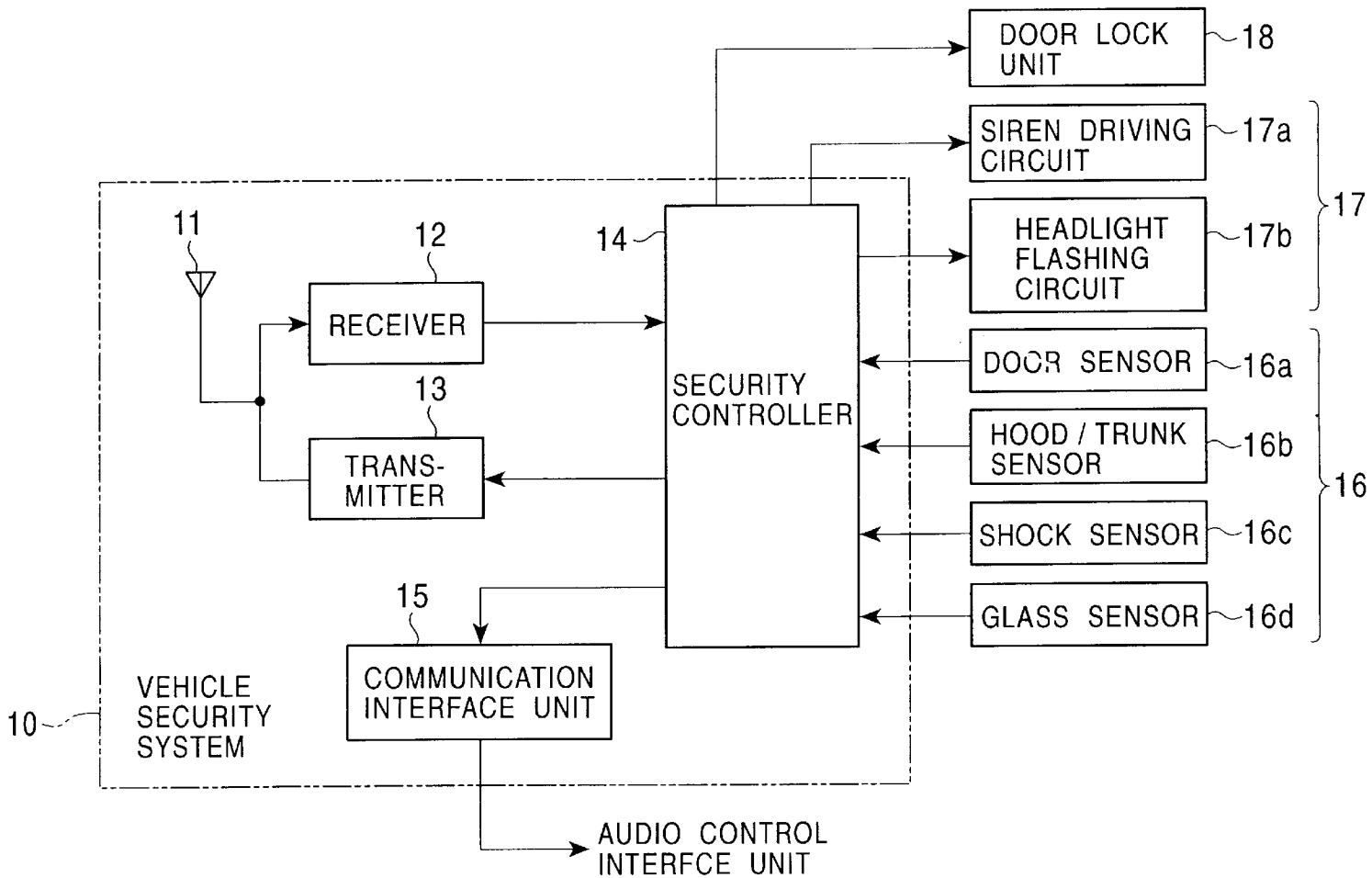
FIG. 5 is a block diagram of the vehicle security system.

FIG. 5 is a block diagram of the vehicle security system 10. The vehicle security system 10 includes a transmitting/receiving antenna 11; a receiver 12 for receiving and demodulating data transmitted from the radio frequency remote control unit 20 by performing high-frequency amplification, frequency conversion, and digital demodulation; a transmitter 13 for digitally modulating the carrier wave in the predetermined modulating system, such as FSK, based on data input by a security controller 14 and transmitting the carrier wave to the radio frequency remote control unit 20; and the security controller 14 formed of a microcomputer. The security controller 14 determines whether the control mode switching is instructed by the radio frequency remote control unit 20 and, if the switching is instructed, the control mode is switched. In the security control mode, the security controller 14 performs security control based on the security control command transmitted from the radio frequency remote control unit 20. In the audio control mode, the security controller 14 outputs the audio control command transmitted from the radio frequency remote control unit 20 to the audio control interface unit 50.

A communication interface unit 15 transmits the audio control command transmitted from the radio frequency remote control unit 20 to the audio control interface unit 50. A fault detection sensor unit 16 includes a door sensor 16*a*, a hood/trunk sensor 16*b* for detecting opening and closing of the vehicle hood and the trunk, a shock sensor 16*c* for detecting a shock applied to the vehicle, and a glass sensor 16*d* for detecting glass breaks, such as windshield breaks. An alarm generation unit 17 includes a siren driving circuit 17*a* and a headlight flashing circuit 17*b*. A door lock unit 18 locks and unlocks a door in response to an instruction given by the security controller 14.

Figure 6:
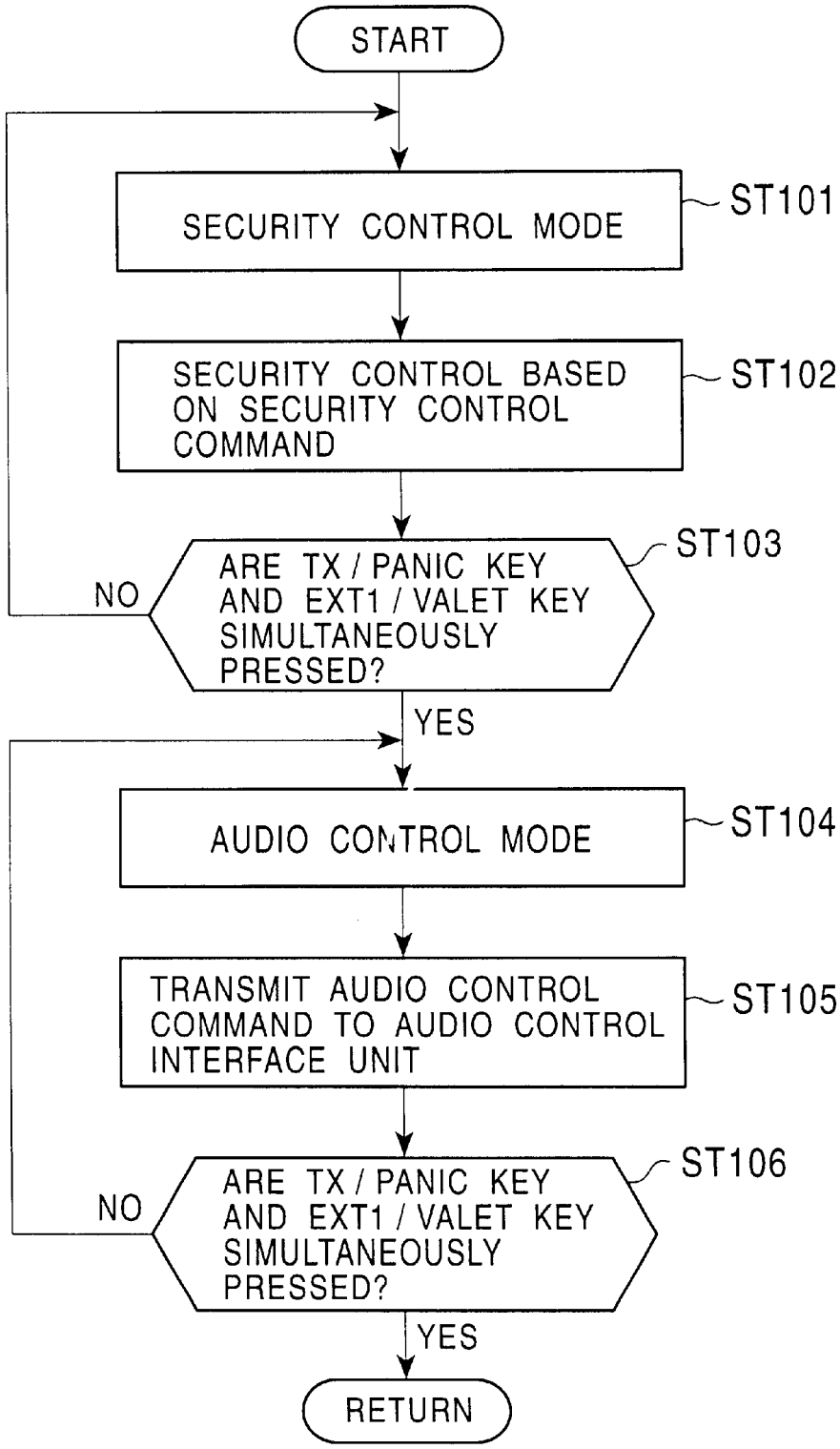
FIG. 6 is a flowchart describing a control mode switching process.

FIG. 6 is a flowchart describing a control mode switching process.

In the initial state in which the ignition switch 70 is turned on, the security controller 14 is in the security control mode (step ST101). The security controller 14 performs security control based on the security control command transmitted from the radio frequency remote control unit 20 (step ST102).

In the security control mode, the security controller 14 monitors whether the control mode switching command is transmitted from the radio frequency remote control unit 20 by simultaneously pressing the TX/PANIC key 22*a* and the EXT1/VALET key 22*b* (step ST103). If the security controller 14 does not receive the control mode switching command, the security controller 14 maintains the security control mode and performs security control using the key operation of the radio frequency remote control unit 20.

If the security controller 14 receives the control mode switching command, the security controller 14 switches the control mode from the security control mode to the audio control mode (step ST104). In response to the reception of the audio control command from the radio frequency remote control unit 20 in the audio control mode, the security controller 14 transmits the audio control command to the audio control interface unit 50 (see FIG. 1) through the communication interface unit 15 (step ST105). In response to the reception of the audio control command, the audio control interface unit 50 converts the command into the infrared remote control unit command. The audio control interface unit 50 generates the infrared remote control signal based on the command obtained by the conversion and drives the infrared emitter 40.

Subsequently, the security controller 14 monitors whether the control mode switching command is transmitted from the radio frequency remote control unit 20 by simultaneously pressing the TX/PANIC key 22*a* and the EXT1/VALET key 22*b* of the radio frequency remote control unit 20 (step ST106). If the security controller 14 does not receive the control mode switching command, the security controller 14 maintains the audio control mode. If the security controller 14 receives the control mode switching command, the process returns to step ST101 and is repeated.

In the security control mode in step ST101, the security controller 14 of the vehicle security system 10 performs security control as described hereinafter. Specifically, the vehicle security system 10 is instructed to be in the armed state when the TX/PANIC key 22*a* of the radio frequency remote control unit 20 (see FIG. 2) is pressed in the security control mode.

In the armed state, the security controller 14 monitors the outputs of the fault detection sensor unit 16 including the door sensor 16*a*, the hood/trunk sensor 16*b*, the shock sensor 16*c*, and the glass sensor 16*d*. If a predetermined sensor is activated, an alarm is generated to trigger the alarm generation unit 17. For example, if the door sensor 16*a* detects the opening of a door in the armed state, the security controller 14 reports to the alarm generation unit 17 about the fault. The alarm generation unit 17 drives the siren and flashes the headlights to drive off thieves.

Subsequently, when a driver who has returned to the vehicle presses the TX/PANIC key 22*a*, the radio frequency remote control unit 20 digitally modulates the carrier wave based on an ID code and a command code for disarming the security and transmits a signal. The transmission signal is received by the antenna 11 of the vehicle security system 10, and is input to the receiver 12 to be demodulated. Subsequently, the security controller 14 determines whether the received ID code agrees with a pre-registered ID code. If the determination is affirmative, a chirp is sounded and the armed state is cleared, and the door lock unit 18 unlocks the door.

Figure 7:
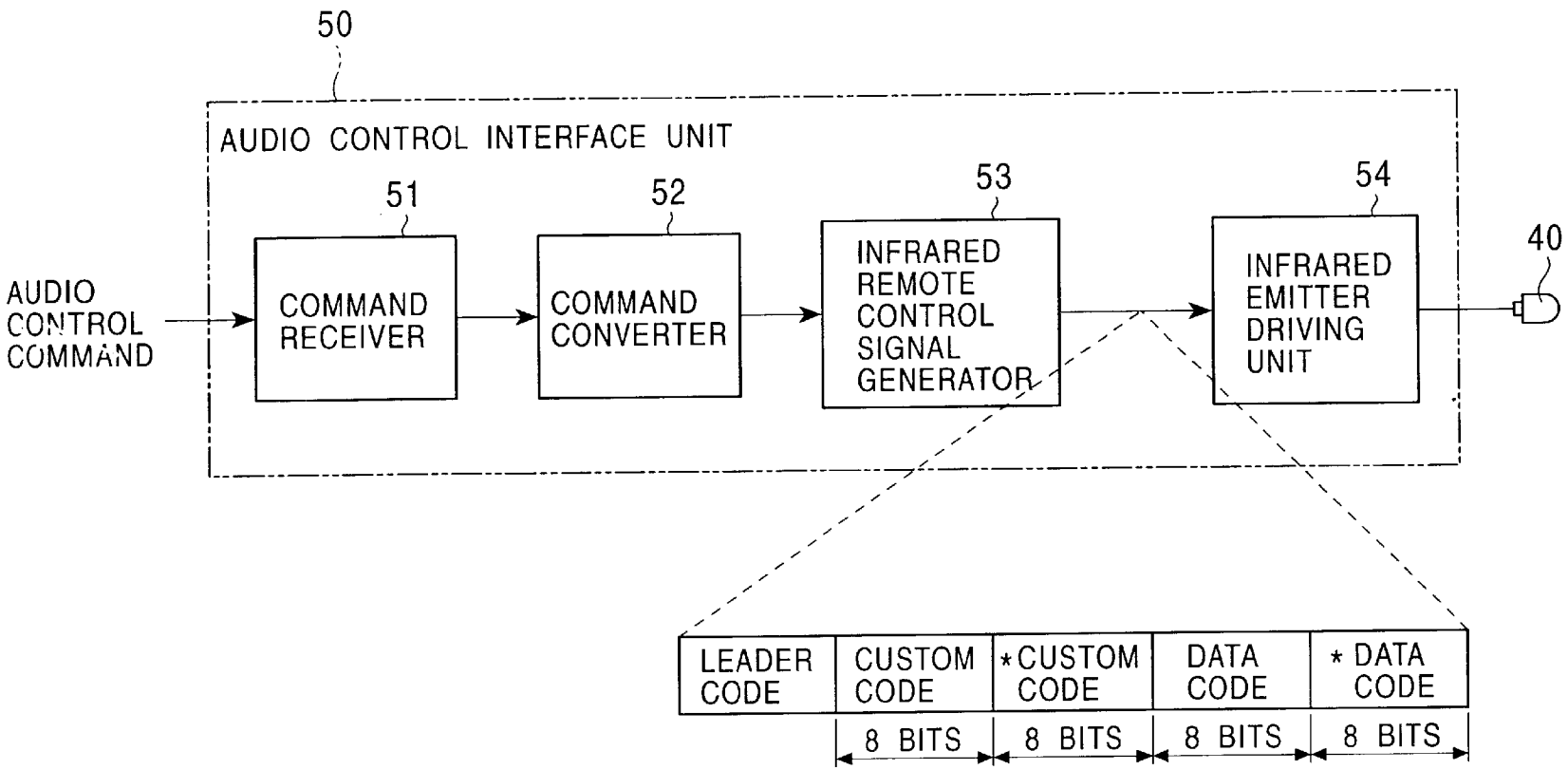
FIG. 7 is a block diagram of an audio control interface unit.
Figure 8:
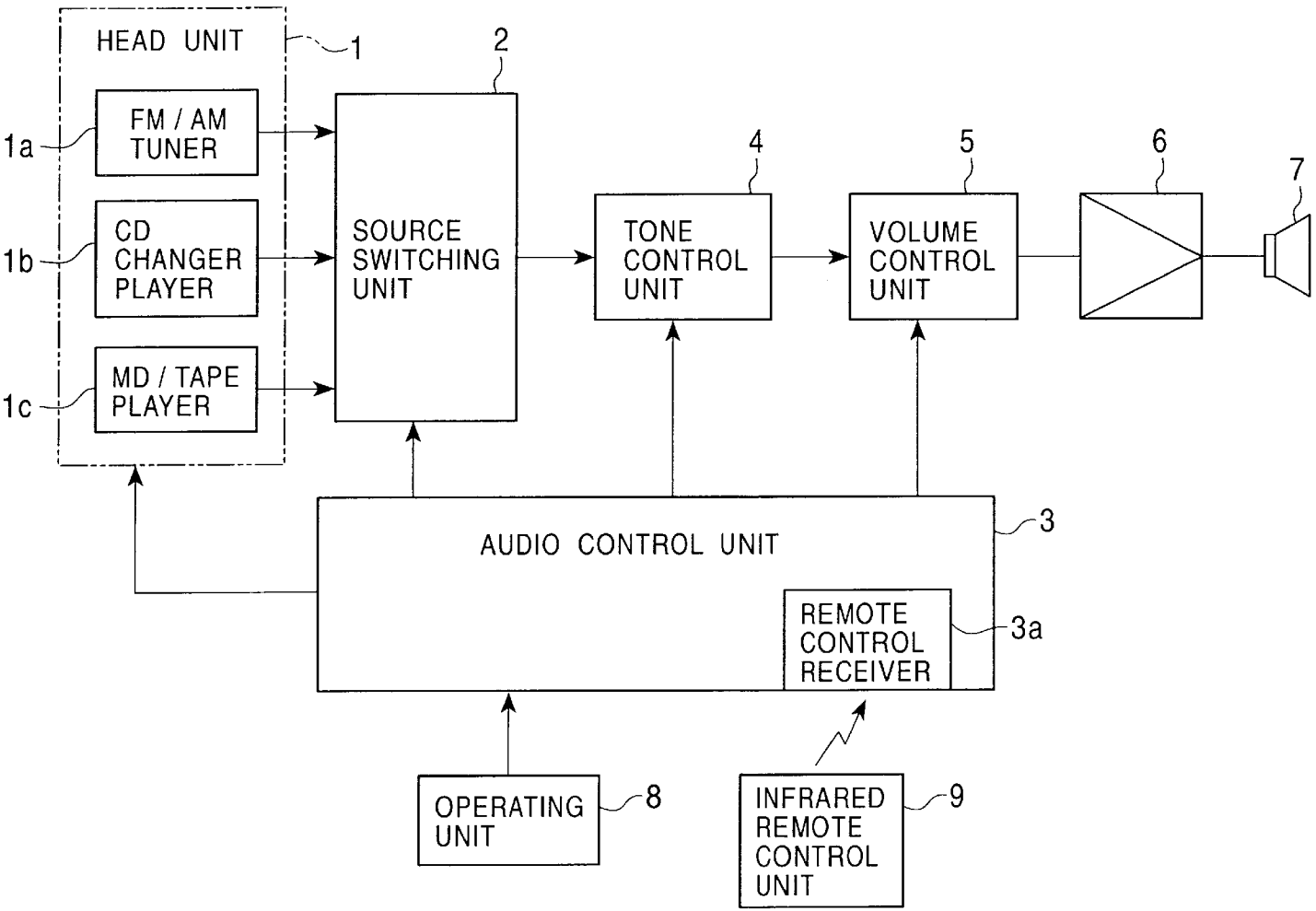
FIG. 8 PRIOR ART
FIG. 8 is a conventional vehicle audio system.

FIG. 7 is a block diagram of the audio control interface unit 50. A command receiver 51 receives the audio control command from the vehicle security system 10. A command converter 52 converts the received audio control command into the infrared remote control unit command. An infrared remote control signal generator 53 generates the infrared remote control signal based on the infrared remote control unit command obtained by the conversion. An infrared emitter driving unit 54 drives the infrared emitter 40 based on the infrared remote control signal. As shown in FIG. 7, the infrared remote control signal is divided into a leader code, an 8-bit custom code, a *custom code which is an inverted custom code, an 8-bit data code, and a *data code which is an inverted data code. Each code employs pulse position modulation (PPM) to distinguish between zero and one based on the pulse spacing.

The audio control interface unit 50 converts the audio control command received from the vehicle security system 10 into the infrared remote control unit command, generates the infrared remote control signal based on the command obtained by the conversion, and inputs the infrared remote control signal to the infrared emitter 40. The infrared emitter 40 emits infrared rays in response to the infrared remote control signal. The infrared receiver 30*a* of the audio system 30 (see FIG. 1) receives the infrared rays emitted by the infrared emitter 40. The audio system 30 performs audio control as instructed by the radio frequency remote control unit 20.

As many apparently widely different embodiments of the present invention can be made without departing from the spirit and scope thereof, it is to be understood that the invention is not limited to the specific embodiments thereof except as defined in the appended claims.

What is claimed is:

1. A method for remotely controlling a vehicle audio system controlled in accordance with an instruction from an infrared remote control unit, said method comprising the steps of:

transmitting from a user's remote control unit an audio control command for controlling the audio system by a high-frequency wireless signal;

receiving and demodulating the audio control command transmitted by the wireless signal; and outputting an infrared remote control signal based on the audio control command to control the vehicle audio system.

2. A method for remotely controlling a vehicle audio system according to claim 1, said method further comprising a step of generating infrared rays by an infrared emitter driven by the infrared remote control signal.

3. A method for remotely controlling a vehicle audio system according to claim 2, said method further comprising a step of receiving the infrared rays emitted by the infrared emitter by a receiver for receiving infrared rays emitted by the infrared remote control unit.

4. A method for remotely controlling a vehicle audio system according to claim 2, wherein the infrared emitter is disposed on a ceiling of the interior of a vehicle.

5. A method for remotely controlling a vehicle audio system according to claim 1, wherein the audio control command is transmitted using a radio frequency remote control unit for transmitting a security control command to a vehicle security system.

6. A method for remotely controlling a vehicle audio system according to claim 5, said method further comprising the steps of:

determining whether switching a control mode between an audio control mode and a security control mode is instructed by the radio frequency remote control unit;

switching the control mode when the determination is affirmative; and when the control mode is switched to the audio control mode, regarding a command received from the radio frequency remote control unit as the audio control command and converting the command into an infrared remote control unit command.

7. A method for remotely controlling a vehicle audio system according to claim 6, wherein the switching of the control mode between the audio control mode and the security control mode is instructed by a predetermined key operation of the radio frequency remote control unit.

8. A method for remotely controlling a vehicle audio system according to claim 6, said method further comprising the steps of:

providing an audio control interface unit, connected to the vehicle security system, for generating the infrared remote control signal;

transmitting the audio control command, received from the radio frequency remote control unit, by the vehicle security system to the audio control interface unit in the audio control mode; and converting, by the audio control interface unit, the audio control command into the infrared remote control unit command and outputting the infrared remote control signal based on the infrared remote control unit command.

9. A vehicle system for remotely controlling an audio system, said vehicle system comprising:

an audio system remotely controlled by infrared rays;

an infrared emitter for generating infrared rays;

a security system for receiving a command transmitted from a radio frequency remote control unit, performing security control in a security control mode based on the command as a security control command, and externally outputting the command transmitted from the radio frequency remote control unit as an audio control command in an audio control mode; and an audio control interface unit, connected to the security system, for converting the audio control command output from the security system into an infrared remote control unit command and driving the infrared emitter based on the infrared remote control unit command.

10. A vehicle system according to claim 9, wherein the security system includes:

a control mode determining unit for determining whether switching a control mode between the audio control mode and the security control mode is instructed by the radio frequency remote control unit; and a transmitter for transmitting the audio control command received from the radio frequency remote control unit to the audio control interface unit in the audio control mode.

11. A vehicle system according to claim 9, wherein the infrared rays emitted by the infrared emitter are received by a receiver for receiving infrared rays emitted by an infrared remote control unit.

12. A vehicle system according to claim 11, wherein the infrared emitter is disposed on a ceiling of the interior of a vehicle.

13. A method for remotely controlling a vehicle audio system in a vehicle containing a security system that can be remotely controlled by a radio frequency remote control unit and an audio system that can be remotely controlled by infrared rays, comprising operating the radio frequency remote control unit to select one of a security control mode and an audio control mode;

transmitting, as a high-frequency wireless signal, a security control command or an audio control command in accordance with said selection;

if a security control command is transmitted, operating the security system in accordance with the security control command; and if an audio control command is transmitted, converting the high-frequency audio control command into an infrared remote control command for operating the audio system.

14. A method for remotely controlling a vehicle audio system according to claim 13, wherein the step of converting the high-frequency audio control command into an infrared remote control command is carried out within the vehicle.

15. A method for remotely controlling a vehicle audio system according to claim 14, wherein the infrared remote control command is emitted from a location on the ceiling of the interior of the vehicle.

16. A method for remotely controlling a vehicle audio system according to claim 13, wherein a determination of the transmitted signal as either a security control command or an audio control command is carried out by the security system on the vehicle.

17. A method for remotely controlling a vehicle audio system according to claim 13, wherein the selection of the security control mode and the audio control mode is made by a predetermined key operation of the radio frequency remote control unit.

18. A system for remotely controlling an audio system in a vehicle, comprising:

an audio system located in the vehicle and remotely controllable by an infrared command signal;

a security system located in the vehicle and remotely controllable by a high-frequency wireless command signal;

a remote control unit for selectively generating a high-frequency wireless signal for controlling the security system or the audio system; and an interface unit which outputs an infrared command signal to control the audio system in response to a high-frequency wireless signal for controlling the audio system being generated by the remote control unit.

19. A system according to claim 18, wherein the security system receives the signal generated by the remote control unit and, if the signal is for controlling the audio system, outputs a command to the interface unit to output the infrared command signal.

* * * * *